United States Patent [19]

Chapman

[11] Patent Number: 4,932,495

[45] Date of Patent: Jun. 12, 1990

[54] VOCAL SOUND MUFFLING DEVICE

[76] Inventor: Dewey R. Chapman, Rte. 2, Box 914, Saltville, Va. 24370

[21] Appl. No.: 276,385

[22] Filed: Nov. 25, 1988

[51] Int. Cl.[5] ..... G10K 11/12

[52] U.S. Cl. ..... 181/242; 181/18; 181/21; 181/258

[58] Field of Search ..... 181/18–22, 181/242, 258, DIG. 1; 381/158, 169, 157

[56] References Cited

U.S. PATENT DOCUMENTS

| | | | |
|---|---|---|---|
| 1,776,584 | 9/1930 | Gerlach, Jr. | 181/242 |
| 2,508,581 | 5/1950 | Morrow | 181/242 X |
| 2,540,873 | 2/1951 | Florman | 181/242 |
| 2,572,547 | 10/1951 | Webb | 181/242 X |
| 2,769,040 | 10/1956 | Di Mattia | 381/158 |
| 2,798,122 | 7/1957 | Ungarsohn | 181/242 X |
| 3,244,816 | 4/1966 | Karns | 181/198 X |
| 4,396,089 | 8/1983 | Scully | 181/242 |

*Primary Examiner*—B. R. Fuller

[57] ABSTRACT

A vocal sound muffling device having an elongated tubular body providing an elongated tubular cavity, a mouthpiece on one end of the body providing an inlet into the cavity for vocal sound waves and atomized fluids, a closure on the other end of the body having a fluid outlet therein for regulating fluid flow from the cavity, and cellular material in the cavity intermediate the inlet and outlet for attenuating the vocal sound waves.

15 Claims, 1 Drawing Sheet

VOCAL SOUND MUFFLING DEVICE

This invention concerns a device for effectively muffling vocal sounds, particularly coughing or sneezing sounds, and has particular utility for substantially deadening such sounds involuntarily made by hunters and the like, wherein the game is easily frightened away by such human noises.

Various devices such as those described in U.S. Pat. Nos.: 2,798,122; 2,769,040; 3,244,816; 1,776,584; 2,540,873; and 4,396,089, the disclosures of which are incorporated herein by reference, have been proposed for muffling vocal sounds made by talking, singing or even shouting. These devices however, are incapable of effectively muting such sound waves or vibrations when they are accompanied by relatively large volumes of air or particulate or comminuted liquids, all of which are hereinafter referred to as fluids, such as emitted by coughing or sneezing. In this regard, it must be noted that while sound waves emitted from the mouth by speaking, singing or yelling are necessarily accompanied by fluid flow, the volume of such flow is minuscule compared to that incident to coughing or sneezing. Consequently, a microphone, voice reporting device or the like can be constructed, as shown in the above patents, without concern for handling substantial flow volumes of fluid. On the other hand, should such devices be subject to the flow volumes incident to coughing or sneezing, the back pressure would be so great that the user would have to remove the device from his nose or mouth to prevent gagging.

Objects therefore of the present invention are: to provide a vocal sound muffling device which can effectively muffle sound waves while accommodating substantial fluid flow volumes; and to provide such a device which is easy to transport and use, and which is easy to disassemble, clean and maintain.

In accordance with the present invention these and further objects hereinafter appearing have been attained by means of the structure which is defined in its broad sense as an elongated tubular body providing an elongated tubular cavity, mouthpiece means on one end of said body providing inlet means into said cavity for vocal sound waves and fluids, closure means on the other end of said body having fluid outlet means therein for regulating fluid flow from said cavity, and cellular material in said cavity intermediate said inlet and outlet means for attenuating said vocal sound waves.

In certain preferred embodiments of the invention:

- the cellular material is of polyurethane or vinyl foam;
- the mouthpiece means is of sufficient dimensions to cover the nose and mouth of the user;
- the mouthpiece is formed to provide an entry chamber for reducing spontaneous pressure;
- the volumetric ratio of the entry chamber to the cellular material is from about 0.5 to about 2.0;
- adjustable valve means is provided in the closure means for regulating fluid flow through the outlet means; and
- the closure means is removable from the body to allow removal of the cellular material from the body for cleaning or replacement.

This invention will be further understood from the following drawings and description, wherein.

Figure 1:
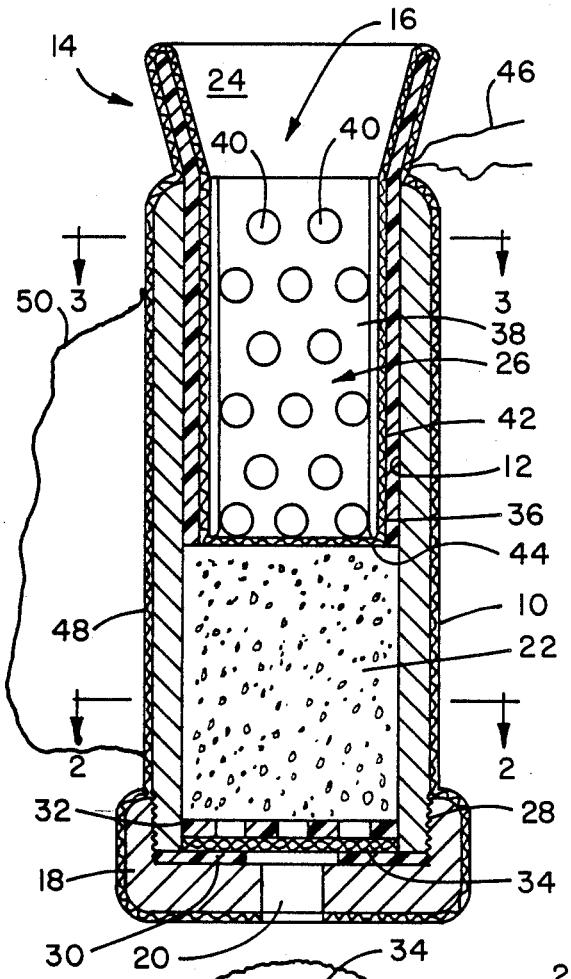
FIG. 1 is a longitudinal sectional view of the present muffling device drawn to an exemplary useful, but not limiting scale.
Figure 3:
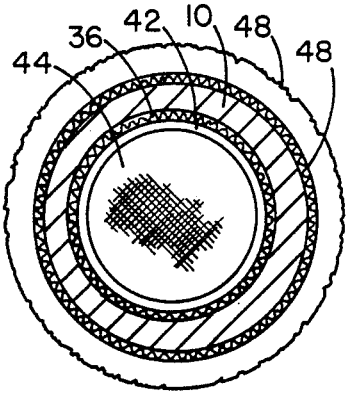
FIG. 3 is a cross-sectional view taken along line 3—3 of FIG. 1 in the direction of the arrows.
Figure 2:
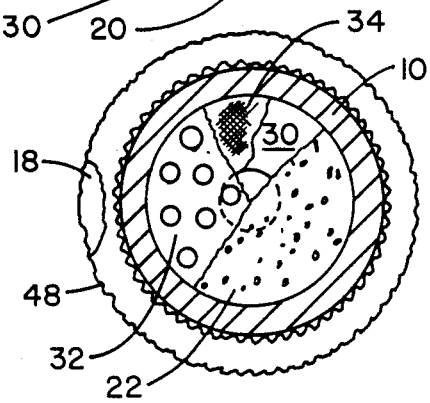
FIG. 2 is a cross-sectional view taken along line 2—2 and lower levels of FIG. 1 in the direction of the arrows.

Referring to the drawings wherein certain dimensions are enlarged for clarity and wherein the overall scale is approximately ⅔ of a preferred size of the device, and with reference to the appended claims, the present device comprises an elongated tubular body 10 providing an elongated tubular cavity 12, mouthpiece means 14 on one end of said body, entry chamber means 16 in said cavity for initially receiving vocal sound waves and fluids, closure means 18 on the other end of said body having fluid outlet means 20 therein for regulating fluid flow from said cavity, and cellular material 22 in said cavity intermediate said inlet and outlet means for attenuating said vocal sound waves.

In more specific terms, body 10 and other structural elements of the device are of plastic or metal, preferably of a non-resonant plastic material such as cellulose acetate butyrate, Nylon, polycarbonate, polyolefin or the like. The body and other structures therein are shown as circular in cross-section, however, any convenient and readily manufacturable shape may be employed including square or oval. The inner walls of the body providing the cavity 12 are preferably smooth such that the other structures can be easily slid therein. The mouthpiece means 14 can be of any convenient configuration such as that shown in the drawings or as shown in the aforementioned patents, and can be sufficiently large to cover the nose and mouth simultaneously. The preferred structure of the mouthpiece is such that its inlet section 24 opens into an adjacent entry chamber 26 of cavity 12 which is sufficiently large to reduce spontaneous back pressure as hereinafter described. Alternatively, the mouthpiece can be on integral extension of the wall of body 10 or can be affixed thereto by plastic cement or mechanical means such as threads. The closure means 18 may be formed integrally with the body 10 but preferably is removably attachable to the body by threads 28 or other mechanical means. The cellular material 22 of foamed plastic or natural sponge is preferably slid into the cavity to the position shown, or where of plastic material may be foamed insitu by known means. This material is prevented from movement toward the outlet 20 by means of retaining washer 30 and an apertured disc 32. A fabric material element 34, preferably of cotton mat or felt, may be placed as shown or on top of disc 32, primarily to supplement the sound attenuation of the cellular material. The cellular material is preferably of polyurethane or vinyl foam wherein the cells are either open or closed, having good sound attenuation properties and providing the necessary passages for good fluid flow therethrough.

In the preferred embodiment of the invention as shown wherein the entry chamber 26 is provided, the volumetric ratio of this chamber to the volume of the cellular material is preferably from about 0.5 to about 2.0, most preferably from about 0.75 to about 1.5. This arrangement allows the user to cough or sneeze into the inlet without experiencing an immediate or spontaneous pressure build-up or back pressure of levels which would tend to force the cough or sneeze back into the body, with of course, disastrous results.

In a further preferred embodiment, mouthpiece 14 and chamber 26 are provided with a highly porous fabric or cloth liner 36 which is conveniently maintained in open condition by means such as a longitudinally split resilient plastic sheath 38 preferably provided with apertures 40 primarily to allow atomized liquids to be absorbed by the sides 42 of liner 36 as well as its bottom portion 44. This structure allows the liner to be easily removed for periodic cleaning to maintain the device in a more biologically acceptable condition. This liner, preferably of camouflage design, is provided with an elastic retainer or drawstring such as 46 to retain it securely on the device. In a further preferred embodiment, an outer cover 48, preferably of elastic fabric material for achieving a snug fit, is provided and may also be of camouflage design. A carrying strap or shoulder sling 50, preferably adjustable, may also be provided and is preferably attached to the cover 48. This cover assists in deadening sound, particularly that which may derive from vibration of the body.

Figure 4:
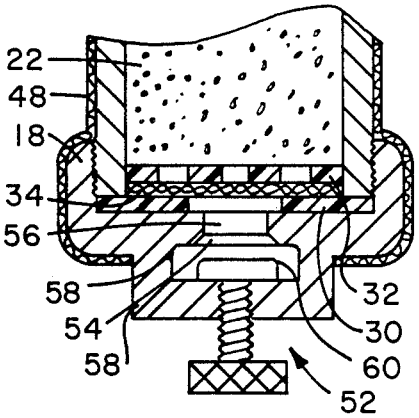
FIG. 4 is a cross-sectional view of the bottom portion of the device fitted with a flow control valve.

Referring to FIG. 4, a screw type flow control valve generally designated 52 is shown in full-open position with respect to its seat 54. The outlet ports 56 and 58 should be sufficiently large to allow the valve head 60 to throttle the fluid flow over all necessary flow ranges. This valve as shown is only exemplary, and any kind or shape of valving mechanism can be used as long as it can conveniently adjust the fluid flow associated with coughing or sneezing.

The invention has been described in detail with particular reference to preferred embodiments thereof, but it will be understood that variations and modifications will be effected within the spirit and scope of the invention.

I claim:

1. A vocal sound muffling device comprising an elongated tubular body having first and second ends and providing an elongated tubular cavity, mouthpiece means on the first end of said body for providing a substantial fluid seal of the device against a user mouth area, substantially closed entry chamber means in said cavity for initially receiving vocal sound waves and fluids, said chamber means having a tubular side wall provided with fluid flow apertures, closure means on the second end of said body having fluid outlet means therein for regulating fluid flow from said cavity, said fluid flow apertures communicating with said fluid outlet means, and cellular material in said cavity intermediate said entry chamber and outlet means and formed to allow a diminished fluid flow therethrough for attenuating said vocal sound waves.

2. The device of claim 1 wherein said cellular material is of polyurethane or vinyl foam.

3. The device of claim 1 wherein said mouthpiece means is of sufficient dimensions to cover a nose and mouth of the user.

4. The device of claim 1 wherein said mouthpiece means is formed to provide said tubular side wall of said entry chamber.

5. The device of claim 4 wherein a volumetric ratio of volume of said entry chamber to a volume of said cellular material is from about 0.5 to about 2.0.

6. The device of claim 5 wherein said volumetric ratio is from about 0.75 to about 1.5.

7. The device of claim 4 wherein a cotton felt barrier is provided in said closure means in a path of said fluid flow of said outlet means.

8. The device of claim 1 wherein adjustable valve means is provided in said closure means for regulating fluid flow through said outlet means.

9. The device of claim 4 wherein said entry chamber is provided with a removable fabric liner.

10. The device of claim 9 wherein said fabric liner is held in expanded condition by a resilient plastic sheath.

11. The device of claim 9 wherein said body is provided with a removable fabric cover.

12. The device of claim 11 wherein said closure means is removable from said body to allow removal of said cellular material from said body.

13. The device of claim 1 wherein said device is provided with a carrying strap.

14. The device of claim 12 wherein said cover is provided with a carrying strap.

15. The device of claim 1 wherein said device is constructed of non-metallic materials.

* * * * *